US011454236B2

(12) United States Patent
Yogo et al.

(10) Patent No.: US 11,454,236 B2
(45) Date of Patent: Sep. 27, 2022

(54) METHOD FOR MANUFACTURING COMPRESSOR CASING, CASING BLANK, AND COMPRESSOR CASING

(71) Applicant: MITSUBISHI HEAVY INDUSTRIES THERMAL SYSTEMS, LTD., Tokyo (JP)

(72) Inventors: Ichiro Yogo, Tokyo (JP); Takeshi Hirano, Tokyo (JP); Yuki Ichise, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 164 days.

(21) Appl. No.: 16/644,078

(22) PCT Filed: Jul. 5, 2018

(86) PCT No.: PCT/JP2018/025533
§ 371 (c)(1),
(2) Date: Mar. 3, 2020

(87) PCT Pub. No.: WO2019/049497
PCT Pub. Date: Mar. 14, 2019

(65) Prior Publication Data

US 2020/0318638 A1 Oct. 8, 2020

(30) Foreign Application Priority Data

Sep. 5, 2017 (JP) ..... JP2017-170396

(51) Int. Cl.
*F04C 18/02* (2006.01)
*F04B 39/12* (2006.01)
(Continued)

(52) U.S. Cl.
CPC ..... *F04C 18/02* (2013.01); *F04B 39/121* (2013.01); *F04C 29/00* (2013.01); *B22D 25/02* (2013.01)

(58) Field of Classification Search
CPC ..... F04C 18/02; F04C 29/00; F04C 29/045; F04B 39/121
See application file for complete search history.

(56) References Cited

U.S. PATENT DOCUMENTS

2002/0085937 A1* 7/2002 Gennami ..... F04C 23/008 418/55.4
2009/0162233 A1* 6/2009 Shimaguchi ..... F04C 23/00 418/186

(Continued)

FOREIGN PATENT DOCUMENTS

DE 11 2013 005 946 T5 8/2015
JP 5518169 B1 6/2014

OTHER PUBLICATIONS

International Search Report for International Application No. PCT/JP2018/025533 dated Sep. 18, 2018, with an English translation.
Written Opinion of the International Searching Authority for International Application No. PCT/JP2018/025533 dated Sep. 18, 2018, with an English translation.

*Primary Examiner* — Deming Wan
(74) *Attorney, Agent, or Firm* — Birch, Stewart, Kolasch & Birch, LLP

(57) ABSTRACT

The present invention comprises: a blank forming step in which a casing blank (70) is formed by die-casting, the casing blank (70) having a first cylindrical section (41), a second cylindrical section (42), and an annular section (44) which includes a recess (71) recessed toward one side in an axial direction (O) from a first surface (44*a*) facing the other side in the axial direction (O); and a cutting step in which the inner peripheral surface (42*a*) of the second cylindrical section (42) and a second surface (44*b*) of the annular section (44), the second surface (44*b*) facing the one side in (Continued)

the axial direction (O), are cut to connect the recess (71) to a compression section containing space (42A) within the second cylindrical section (42), thereby forming a flow passage. In the blank forming step, the casing blank (70) is formed such that a part of a side surface (71*a*) of the recess (71) is disposed radially outside the inner peripheral surface (42*a*) of the second cylindrical section (42).

19 Claims, 9 Drawing Sheets

(51) Int. Cl.

| | |
|---|---|
| ***F04C 29/00*** | (2006.01) |
| ***F04C 29/04*** | (2006.01) |
| *B22D 25/02* | (2006.01) |

(56) References Cited

U.S. PATENT DOCUMENTS

| | | | | |
|---|---|---|---|---|
| 2010/0183465 | A1* | 7/2010 | Kobayashi | F04C 18/0215 418/55.1 |
| 2014/0112817 | A1* | 4/2014 | Osaki | F16F 1/047 418/266 |
| 2014/0134030 | A1* | 5/2014 | Stover | F04C 18/0207 418/55.1 |
| 2015/0303762 | A1 | 10/2015 | Hagita et al. | |
| 2016/0010633 | A1* | 1/2016 | Hagita | F01C 21/10 29/428 |
| 2020/0173443 | A1* | 6/2020 | Ichise | F04C 29/028 |

* cited by examiner

70

METHOD FOR MANUFACTURING COMPRESSOR CASING, CASING BLANK, AND COMPRESSOR CASING

TECHNICAL FIELD

The present invention relates to a method for manufacturing a compressor casing, a casing blank, and a compressor casing.

Priority is claimed on Japanese Patent Application No. 2017-170396, filed on Sep. 5, 2017, the content of which is incorporated herein by reference.

BACKGROUND ART

As one of compressors, a scroll compressor is known. The scroll compressor includes a compressor casing, a motor, and a compression unit. The motor and the compression unit are housed in a space formed inside the compressor casing (for example, refer to PTL 1).

PTL 1 discloses the compressor casing that has a first cylindrical part, a second cylindrical part, and an annular part. The first cylindrical part defines a motor housing space which houses the motor. The second cylindrical part is connected to the first cylindrical part in an axial direction. The second cylindrical part defines a compression unit housing space which houses the compression unit. The compression unit housing space has a smaller diameter than the motor housing space.

The annular part protrudes inward in a radial direction from an inner peripheral surface of a boundary portion between the first cylindrical part and the second cylindrical part.

The above-described annular part has a flow path (penetrating portion) formed to guide a lubricant supplied into the motor housing space and a fluid compressed by the compression unit from the motor housing space to the compression unit housing space. The flow path is formed in such a way that a casing blank serving as a base material of the compressor casing is processed using a tool.

CITATION LIST

Patent Literature

[PTL 1] Japanese Patent No. 5518169

SUMMARY OF INVENTION

Technical Problem

From a viewpoint of efficiently guiding the fluid and the lubricant from the motor housing space to the compression unit housing space, it is preferable that the flow path has a large cross-sectional area.

However, in a case of a structure where the compression unit housing space has the smaller diameter than the motor housing space, the flow path having the large cross-sectional area is less likely to be processed using the tool in the casing blank serving as the base material of the compressor casing.

Therefore, the present invention aims to provide a method for manufacturing a compressor casing, a casing blank, and a compressor casing, which can increase a flow path cross-sectional area of a flow path formed in an annular part.

Solution to Problem

According to an aspect of the present invention, in order to solve the above-described problem, there is provided a method for manufacturing a compressor casing. The method includes a blank forming step of using die cast molding to form a casing blank having a first cylindrical part which has a cylindrical shape around an axis, and which internally defines a motor housing space, a second cylindrical part which has a cylindrical shape around the axis, which internally defines a compression unit housing space having a smaller diameter than the motor housing space, and which is connected to one side of the first cylindrical part in an axial direction, and an annular part which protrudes inward in a radial direction from an inner peripheral surface of a boundary portion between the first cylindrical part and the second cylindrical part, and which includes a recessed portion recessed in a direction facing one side in the axial direction from a first surface facing the other side in the axial direction, and a machining step of forming a flow path in such a way that the recessed portion is caused to communicate with the compression unit housing space by machining an inner peripheral surface of the second cylindrical part and a second surface facing one side of the annular part in the axial direction. In the blank forming step, the casing blank is formed so that a portion of a side surface of the recessed portion is located outward in the radial direction from the inner peripheral surface of the second cylindrical part.

According to the present invention, the die cast molding is used. Therefore, the recessed portion can be formed in a die casting step of forming the casing blank without separately providing a step of forming the recessed portion to configure the recessed portion (recessed portion that configures a portion of the flow path) in which the side surface is located outward in the radial direction from the inner peripheral surface of the second cylindrical part. In this manner, it is possible to simplify a step of manufacturing a casing material.

In addition, the inner peripheral surface of the second cylindrical part and the second surface of the annular part are machined to cause the recessed portion to communicate with the compression unit housing space. In this manner, it is possible to form the flow path having a larger flow path cross-sectional area than the flow path in the related art.

In addition, the recessed portion is caused to communicate with the compression unit housing space during the machining (process performed in the related art) performed as a finishing process of the compression unit housing space. In this manner, it is possible to prevent an increase in steps for forming the flow path.

In addition, in the method for manufacturing the compressor casing according to the aspect of the present invention, in the machining step, the annular part may be thinned so that a portion of the flow path is located in the second cylindrical part.

In this way, a portion of the flow path is located in the second cylindrical part. In this manner, it is possible to increase the flow path cross-sectional area of the flow path on the second surface side of the annular part.

In addition, in the method for manufacturing the compressor casing according to the aspect of the present invention, in the blank forming step, a plurality of the recessed portions may be formed in a circumferential direction of the annular part.

In this way, the plurality of recessed portions are formed in the circumferential direction of the annular part. In this manner, the plurality of flow paths having the large flow path cross-sectional area can be formed in the circumferential direction of the annular part.

In addition, in the method for manufacturing the compressor casing according to the aspect of the present invention, the plurality of recessed portions include a lower recessed portion formed in a lower portion of the annular part. In the blank forming step, the casing blank may be formed so that at least a portion adjacent to the lower recessed portion in the first cylindrical part is reduced in diameter toward the first surface from the other side of the first cylindrical part in the axial direction.

In this way, the casing blank is formed so that at least the portion of adjacent to the lower recessed portion in the first cylindrical part is reduced in diameter toward the first surface from the other side of the first cylindrical part in the axial direction. In this manner, a step difference formed between the first cylindrical part and the lower flow path (portion of the lower recessed portion) can be smoothed and reduced. In this manner, a liquid lubricant collected in the lower portion of the casing blank can be easily moved to the compression unit housing space side via the lower flow path.

In addition, in the method for manufacturing the compressor casing according to the aspect of the present invention, in the blank forming step, in a state where the annular part is viewed in the axial direction from the motor housing space of the first cylindrical part, the lower recessed portion may be formed to further extend to an outer peripheral side of the annular part from the other recessed portion.

In this way, in a state where the annular part is viewed in the axial direction from the motor housing space side, the lower recessed portion is formed to further extend to the outer peripheral side of the annular part from the other recessed portion. In this manner, the step difference formed between the first cylindrical part and the lower flow path (portion of the lower recessed portion) can be reduced.

In this manner, the liquid lubricant collected in the lower portion of the motor housing space can be easily moved to the compression unit housing space side via the lower flow path.

In addition, in the method for manufacturing the compressor casing according to the aspect of the present invention, in the blank forming step, the plurality of recessed portions may be formed to have different circumferential widths of the annular part.

In this way, the plurality of recessed portions are formed to have the different circumferential directions of the annular part. In this manner, the plurality of recessed portions can be formed to avoid a member located on the second surface side of the annular part. In this manner, the plurality of flow paths can be formed to avoid the member located on the second surface side of the annular part.

According to another aspect of the present invention, in order to solve the above-described problem, there is provided a casing blank including a first cylindrical part which has a cylindrical shape around an axis, and which internally defines a motor housing space, a second cylindrical part which has a cylindrical shape around the axis, which internally defines a compression unit housing space having a smaller diameter than the motor housing space, and which is connected to one side of the first cylindrical part in an axial direction, and an annular part which protrudes inward in a radial direction from an inner peripheral surface of a boundary portion between the first cylindrical part and the second cylindrical part, and which includes a recessed portion recessed in a direction facing one side in the axial direction from a first surface facing the other side in the axial direction. A portion of a side surface of the recessed portion is located outward in the radial direction from an inner peripheral surface of the second cylindrical part. The recessed portion serves as a flow path which causes the motor housing space and the compression unit housing space to communicate with each other by machining an inner peripheral surface of the second cylindrical part and a second surface facing one side of the annular part in the axial direction.

According to the present invention, the casing blank has the annular part including the recessed portion in which the side surface is located outward in the radial direction from the inner peripheral surface of the second cylindrical part. Therefore, it is possible to increase the diameter of the recessed portion.

In this manner, it is possible to obtain the flow path (for example, the flow path of the fluid or the lubricant) having the larger flow path cross-sectional area than the flow path in the related art.

In addition, in the casing blank according to the aspect of the present invention, a plurality of the recessed portions may be formed in a circumferential direction of the annular part.

In this way, the plurality of recessed portions are formed in the circumferential direction of the annular part. In this manner, the plurality of flow paths having the large flow path cross-sectional area can be located in the circumferential direction of the annular part.

In addition, in the casing blank according to the aspect of the present invention, the plurality of recessed portions may have a lower recessed portion formed in a lower portion of the annular part. At least a portion adjacent to the lower recessed portion in the first cylindrical part may be reduced in diameter toward the first surface from the other side of the first cylindrical part in the axial direction.

In this way, at least the portion adjacent to the lower recessed portion in the first cylindrical part is reduced in diameter toward the first surface from the other side of the first cylindrical part in the axial direction. In this manner, the step difference formed between the first cylindrical part and the recessed portion formed in the annular part can be smoothed and reduced.

In this manner, the liquid lubricant collected in the lower portion of the casing blank can be easily moved to the compression unit housing space side via the flow path (portion of the lower recessed portion).

In addition, in the casing blank according to the aspect of the present invention, in a state where the annular part is viewed in the axial direction from the motor housing space of the first cylindrical part, the lower recessed portion may be located to further extend to an outer peripheral side of the annular part from the other recessed portion.

In this way, in a state where the annular part is viewed in the axial direction from the motor housing space side, the lower recessed portion is located to further extend to the outer peripheral side of the annular part from the other recessed portion. In this manner, the step difference formed between the first cylindrical part and the recessed portion formed in the annular part can be reduced.

In this manner, the liquid lubricant collected in the lower portion of the casing blank can be easily moved to the compression unit housing space side via the flow path (portion of the lower recessed portion).

In addition, in the casing blank according to the aspect of the present invention, the plurality of recessed portions may have different circumferential widths of the annular part.

In this way, the plurality of recessed portions are formed to have the different circumferential directions of the annular part. In this manner, the plurality of recessed portions can be located to avoid the member located on the second surface side of the annular part.

In this manner, the plurality of flow paths can be located to avoid the member located on the second surface side of the annular part.

According to still another aspect of the present invention, in order to solve the above-described problem, there is provided a compressor casing including a first cylindrical part which has a cylindrical shape around an axis, and which internally defines a motor housing space, a second cylindrical part which has a cylindrical shape around the axis, which internally defines a compression unit housing space having a smaller diameter than the motor housing space, and which is connected to one side of the first cylindrical part in an axial direction, and an annular part which protrudes inward in a radial direction from an inner side of a boundary portion between the first cylindrical part and the second cylindrical part, and which includes a flow path that causes the motor housing space and the compression unit housing space to communicate with each other. The flow path may be formed in such a way that a recessed portion formed in the annular part is caused to communicate with the compression unit housing space by machining an inner peripheral surface of the second cylindrical part and a surface facing one side of the annular part in the axial direction. A portion of an inner peripheral surface of the flow path may be located outward in the radial direction from the inner peripheral surface of the second cylindrical part before the machining is performed.

According to the present invention, a portion of the inner peripheral surface of the flow path is located outward in the radial direction from the inner peripheral surface of the second cylindrical part before the machining is performed. In this manner, it is possible to increase the flow path cross-sectional area.

In addition, in the compressor casing according to the aspect of the present invention, a portion of the flow path may be formed in the second cylindrical part, and the flow path extends to the compression unit housing space.

In this way, a portion of the flow path is formed in the second cylindrical part. In this manner, it is possible to increase the flow path cross-sectional area of the flow path on the second surface side of the annular part.

In addition, in the compressor casing according to the aspect of the present invention, a plurality of the flow paths may be formed in a circumferential direction of the annular part.

In this manner, the plurality of flow paths having the large flow path cross-sectional area can be located in the circumferential direction of the annular part.

In addition, in the compressor casing according to the aspect of the present invention, the plurality of flow paths may have a lower flow path formed in a lower portion of the annular part. A portion adjacent to the lower flow path in the first cylindrical part may be reduced in diameter toward the first surface facing the other side of the annular part in the axial direction from the other side of the first cylindrical part in the axial direction.

In this way, at least the portion adjacent to the lower flow path in the first cylindrical part is reduced in diameter toward the first surface facing the other side of the annular part in the axial direction from the other side of the first cylindrical part in the axial direction. In this manner, the step difference formed between the first cylindrical part and the lower flow path can be smoothed and reduced.

In this manner, the liquid lubricant collected in the lower portion of the compressor casing can be easily moved to the compression unit housing space side via the lower flow path.

In addition, in the compressor casing according to the aspect of the present invention, a portion of the lower flow path may be formed in the second cylindrical part. At least a surface located on the inner peripheral surface side of the second cylindrical part on the partial surface of the lower flow path may be a curved surface.

In this way, at least the surface located on the inner peripheral surface side of the second cylindrical part within a partial surface of the lower flow path formed in the second cylindrical part is formed as the curved surface. In this manner, the liquid lubricant flowing in the lower flow path can easily flow to the inner peripheral surface side of the second cylindrical part.

In addition, in the compressor casing according to the aspect of the present invention, in a state where the annular part is viewed in the axial direction from the motor housing space side of the first cylindrical part, the lower flow path may be located to further extend to an outer peripheral side of the annular part from the other flow path.

In this way, in a state where the annular part is viewed in the axial direction from the motor housing space side, the lower flow path is located to further extend to the outer peripheral side of the annular part from the other flow path. In this manner, the step difference formed between the first cylindrical part and the lower flow path can be reduced.

In this manner, the liquid lubricant collected in the lower portion of the motor housing space can be easily moved to the compression unit housing space side.

In addition, in the compressor casing according to the aspect of the present invention, the plurality of flow paths may have different circumferential widths of the annular part.

In this way, the plurality of flow paths are formed to have the different circumferential directions of the annular part. In this manner, the plurality of flow paths can be located to avoid the member located on the second surface side of the annular part.

Advantageous Effects of Invention

According to the present invention, it is possible to increase the flow path cross-sectional area of the flow path formed in the annular part.

DESCRIPTION OF EMBODIMENTS

Hereinafter, embodiments to which the present invention is applied will be described in detail with reference to the drawings.

First Embodiment

Figure 1:
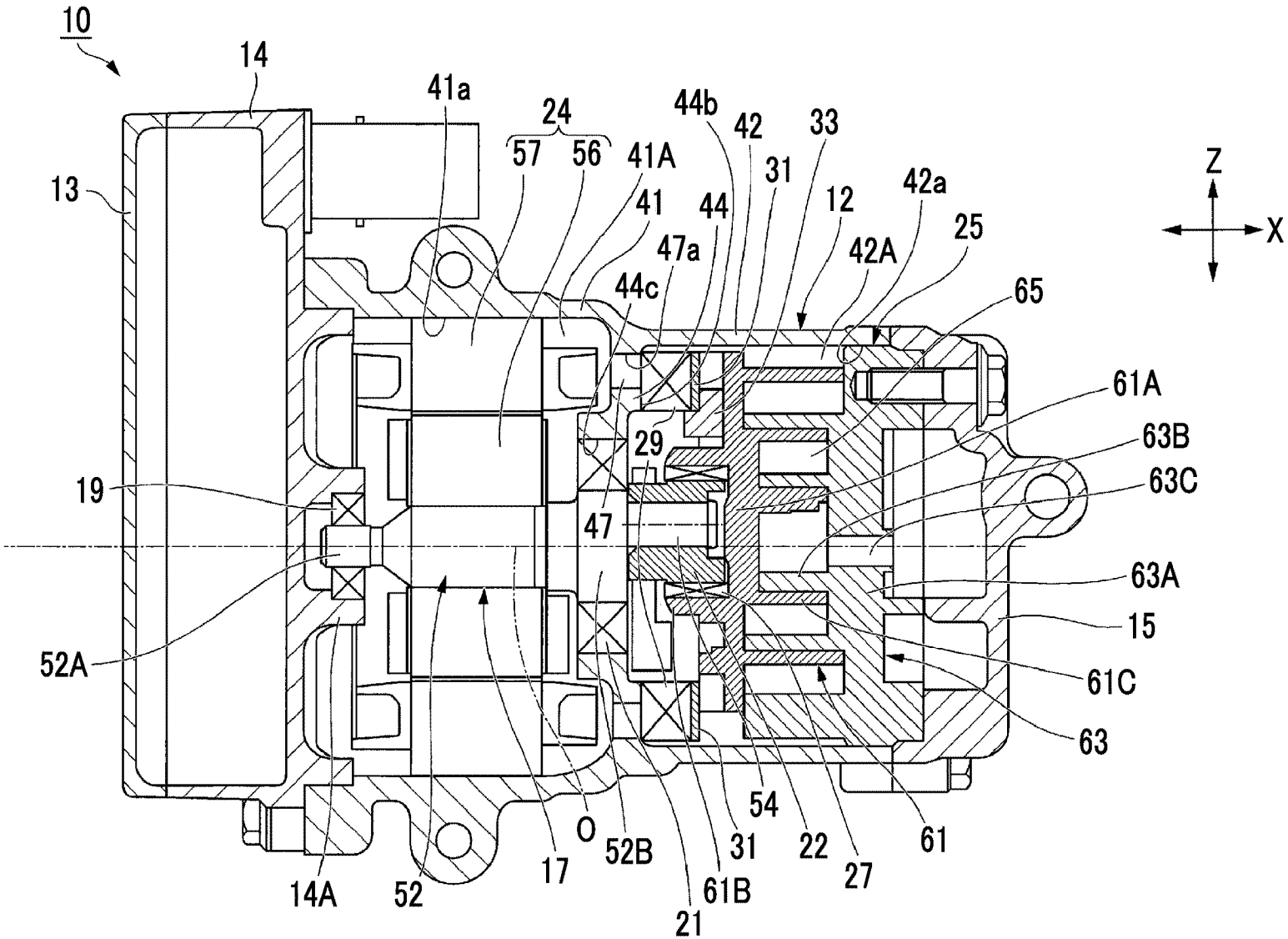
FIG. 1 is a sectional view schematically illustrating a brief configuration of a compressor according to a first embodiment of the present invention.

A compressor 10 including a compressor casing 12 according to a first embodiment will be described with reference to FIG. 1. In FIG. 1, O represents an axis (hereinafter, referred to as an "axis O") of a rotary shaft 17, an X-direction (hereinafter, referred to as an "axial direction") represents an extending direction of the axis O of the rotary shaft 17, and a Z-direction represents a vertical direction perpendicular to the X-direction, respectively.

The axis O is an axis of the rotary shaft 17, and is also each axis of first and second cylindrical parts 41 and 42. In addition, FIG. 1 illustrates a scroll compressor as an example of the compressor 10.

The compressor 10 has a compressor casing 12, a cover 14, a first lid body 13, a second lid body 15, the rotary shaft 17, radial bearings 19, 21, and 27, a drive bush 22, a motor 24, a compression unit 25, a thrust bearing 29, a thrust plate 31, and an Oldham ring 33.

Figure 2:
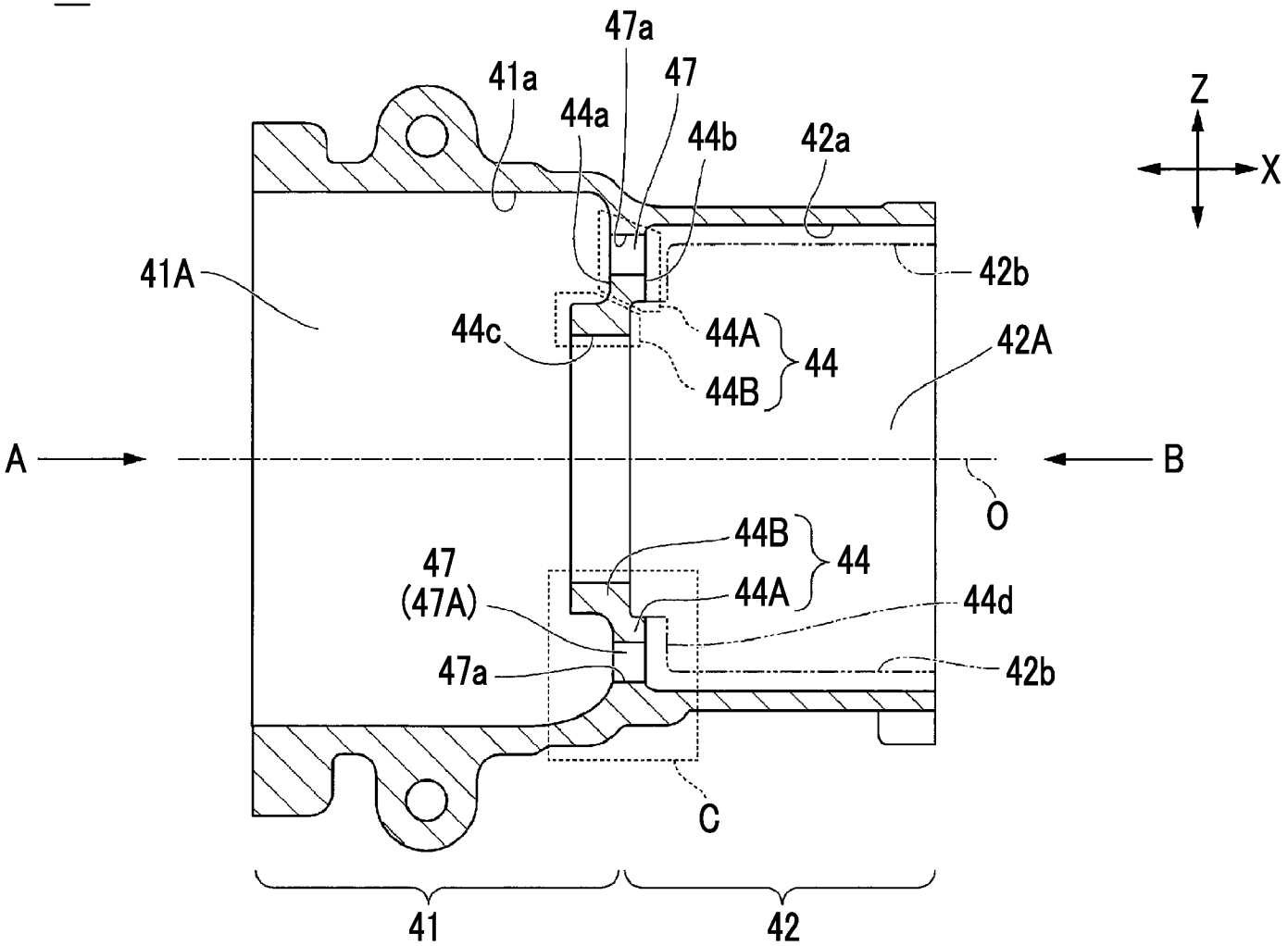
FIG. 2 is a sectional view illustrating a compressor casing illustrated in FIG. 1.

Next, the compressor casing 12 according to the first embodiment will be described with reference to FIGS. 1 to 5. In FIG. 2, an inner peripheral surface 42*b* indicates an inner peripheral surface of the second cylindrical part 42 before a casing blank 70 (base material of the compressor casing 12) illustrated in FIG. 7 (to be described later) is internally machined.

Figure 7:
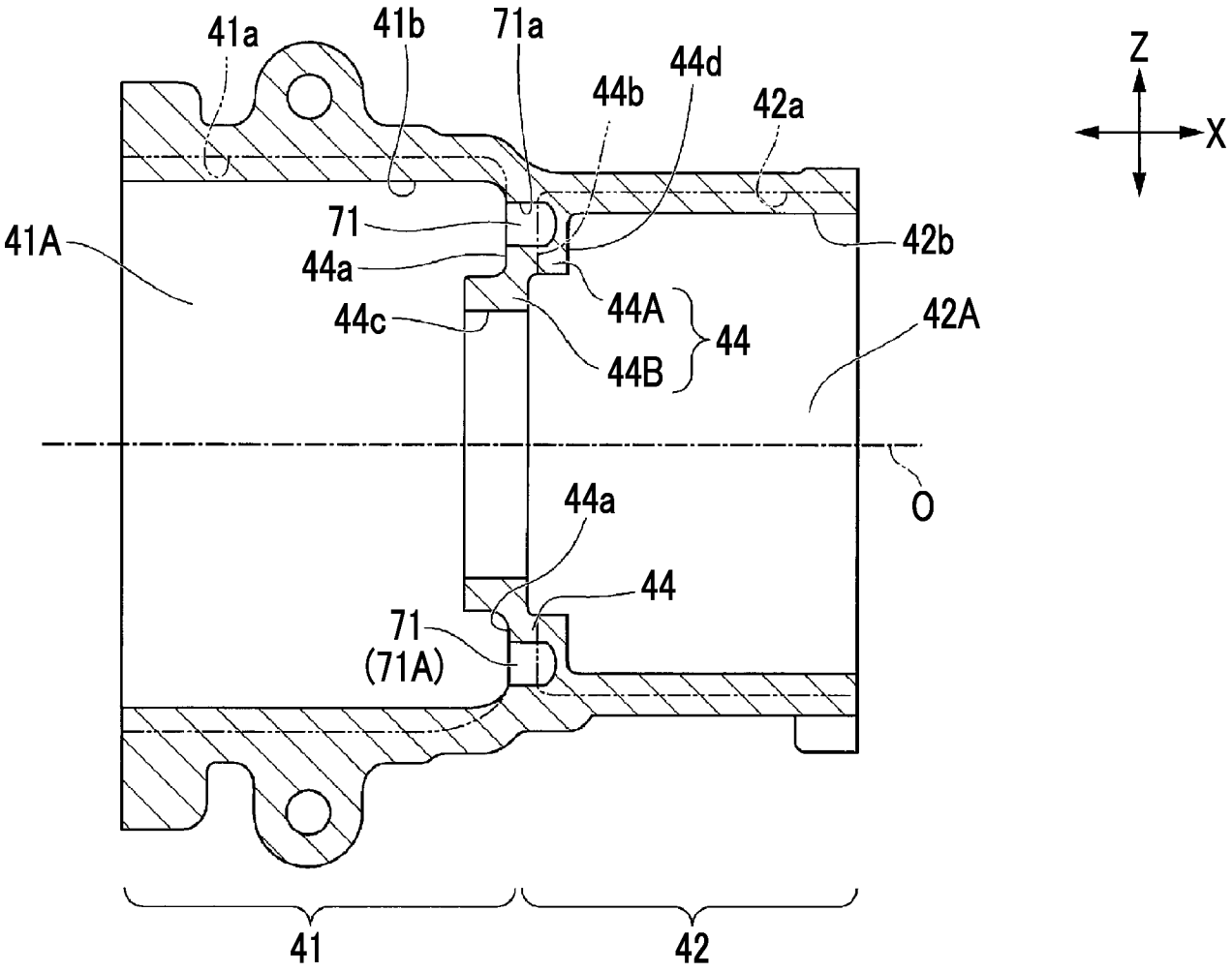
FIG. 7 is a sectional view illustrating a casing blank according to the first embodiment.

In addition, in FIG. 2, a second surface 44*d* indicates a second surface of an annular part 44 before the casing blank 70 (base material of the compressor casing 12) illustrated in FIG. 7 is internally machined.

Figure 3:
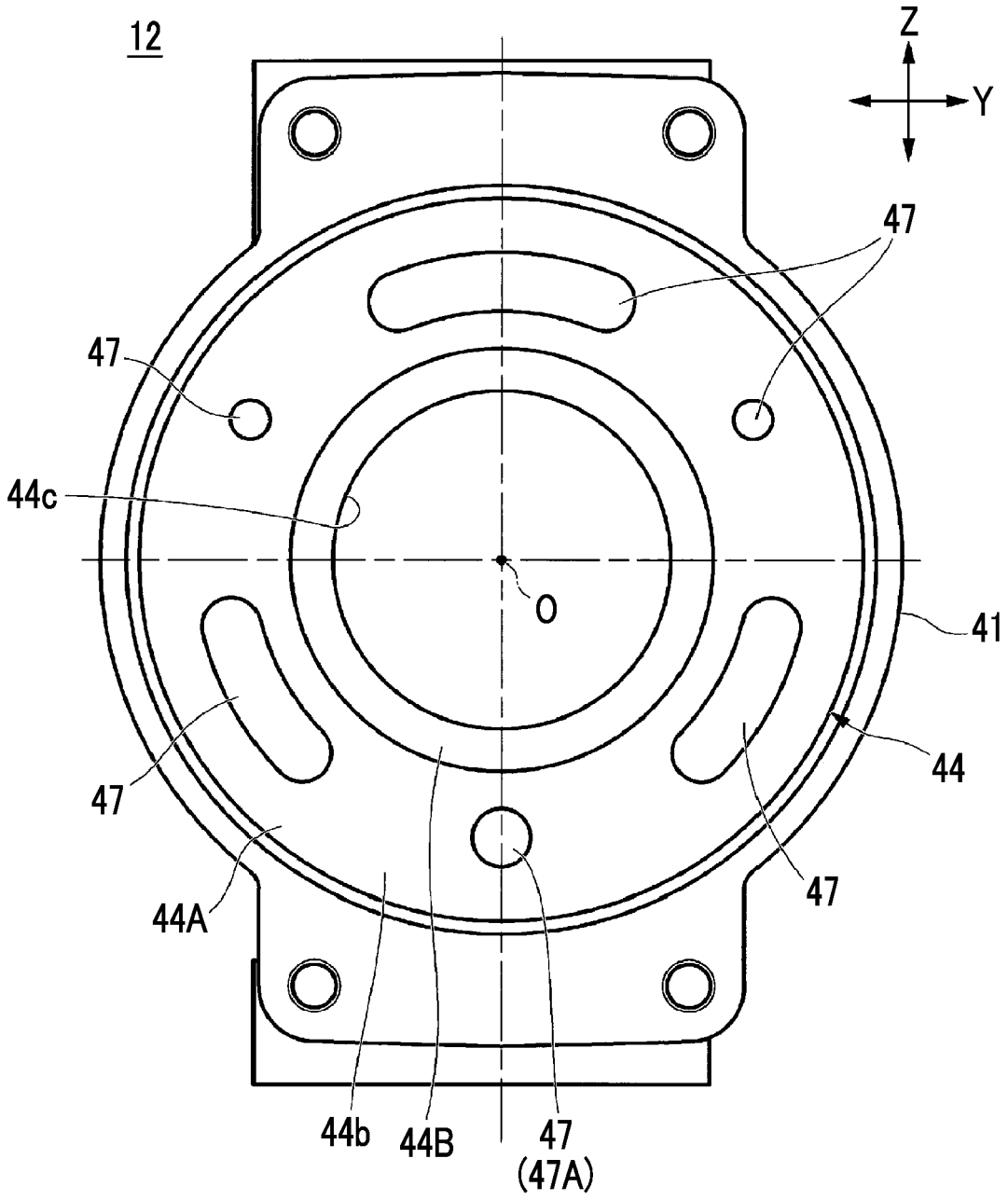
FIG. 3 is a view when the compressor casing illustrated in FIG. 2 is viewed from an arrow A.
Figure 4:
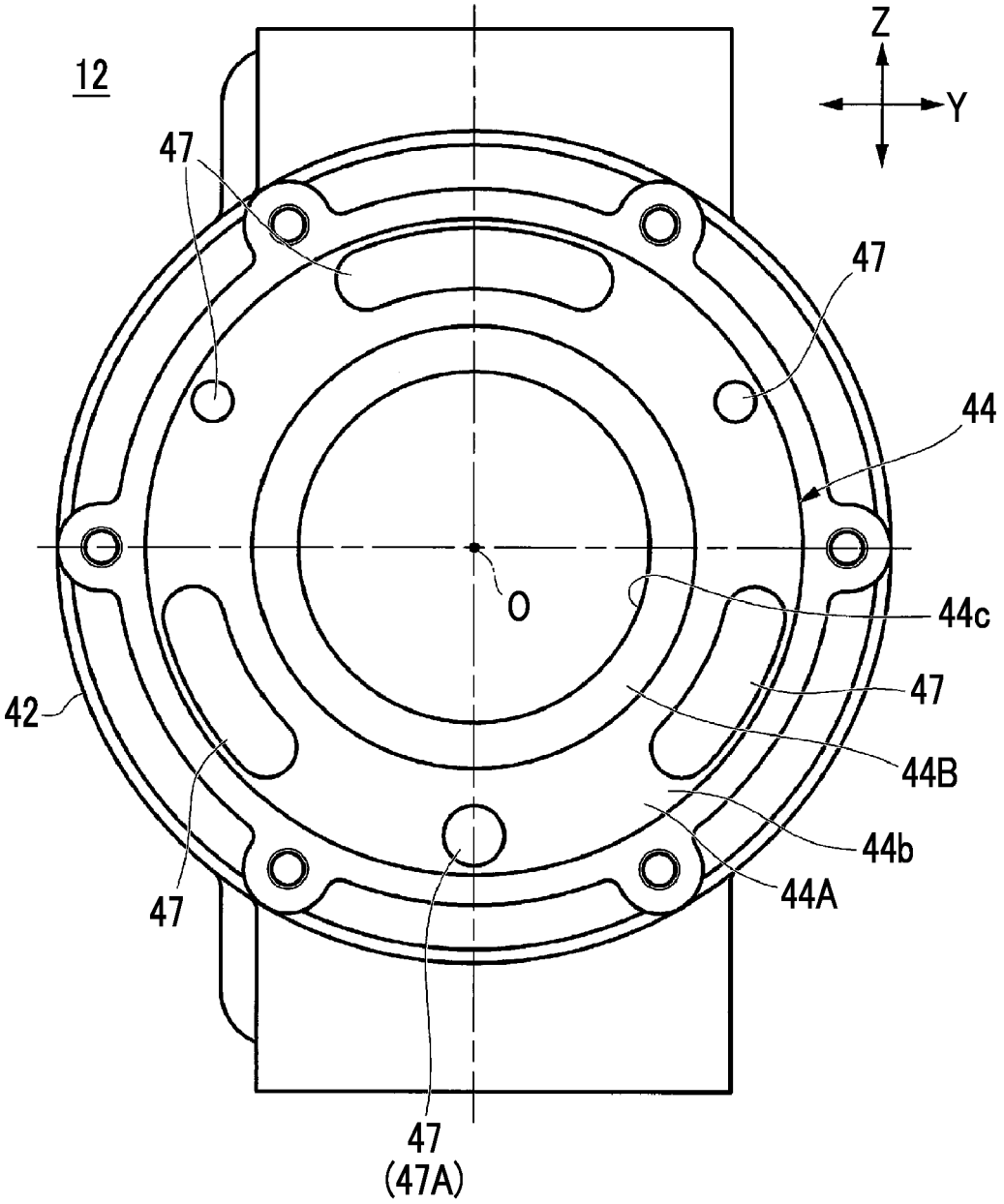
FIG. 4 is a view when the compressor casing illustrated in FIG. 2 is viewed from an arrow B.

A Y-direction illustrated in FIG. 3 indicates a direction perpendicular to the X-direction and the Z-direction. In FIGS. 1 to 5, the same reference numerals will be given to the same configuration materials.

The compressor casing 12 includes the first cylindrical part 41, the second cylindrical part 42, and the annular part 44.

The first cylindrical part 41 is a member having a cylindrical shape around the axis O. Both ends of the first cylindrical part 41 are open ends.

The first cylindrical part 41 has an inner peripheral surface 41*a* and a motor housing space 41A. The motor housing space 41A is a columnar space defined by the inner peripheral surface 41*a* of the first cylindrical part 41. The motor housing space 41A is a space formed inside the first cylindrical part 41. The motor 24 is housed in the motor housing space 41A.

A mist-like lubricant is supplied from the outside of the compressor casing 12, and a refrigerant is supplied from an A/C system to the motor housing space 41A.

The second cylindrical part 42 is a member having a cylindrical shape around the axis O. Both ends of the second cylindrical part 42 are open ends.

The second cylindrical part 42 has an inner peripheral surface 42*a* and a compression unit housing space 42A. The compression unit housing space 42A is a columnar space defined by the inner peripheral surface 42*a* of the second cylindrical part 42. The compression unit housing space 42A is a space formed inside the second cylindrical part 42. The compression unit 25 is housed in the compression unit housing space 42A.

The annular part 44 protrudes inward in a radial direction of the compressor casing 12 from an inner peripheral surface of a boundary portion between the first cylindrical part 41 and the second cylindrical part 42. The annular part 44 has a first portion 44A including a plurality of flow paths 47, and a second portion 44B.

The first portion 44A extends inward in a circumferential direction from the inside of the boundary portion between the first cylindrical part 41 and the second cylindrical part 42. The first portion 44A is a ring-shaped member.

The first portion 44A has a first surface 44*a*, a second surface 44*b*, and the plurality of flow paths 47. The first surface 44*a* is a surface which faces the other side in a direction of the axis O direction (other side in the axial direction). The second surface 44*b* is a surface which faces one side in the direction of the axis O direction (one side in the axial direction).

The plurality of flow paths 47 are disposed to penetrate the first portion 44A in the X-direction. The plurality of flow paths 47 are located in the circumferential direction of the first portion 44A in a state having an interval therebetween.

In the plurality of flow paths 47, one end is exposed on the first surface 44*a*, and the other end is exposed on the second surface 44*b*. The plurality of flow paths 47 cause the motor housing space 41A and the compression unit housing space 42A to communicate with each other.

The plurality of flow paths 47 are formed as follows. The inner peripheral surface 42*b* of the second cylindrical part 42 and the second surface 44*d* of the annular part 44 which configure the casing blank 70 illustrated in FIG. 7 are machined. In this manner, a recessed portion 71 (refer to FIG. 7, to be described later) formed in the annular part 44 is caused to communicate with the compression unit housing space 42A.

A portion of the inner peripheral surface 47*a* of the plurality of flow paths 47 is located outward in the radial direction from the inner peripheral surface 42*a* of the second cylindrical part 42 before the machining is performed.

In this way, a portion of the inner peripheral surface 47*a* of the flow path 47 is located outward in the radial direction from the inner peripheral surface 42*b* of the second cylindrical part 42 (second cylindrical part 42 of the casing blank 70) before the machining is performed.

In this manner, it is possible to increase a flow path cross-sectional area of the flow path 47 than the flow path in the related art.

In this manner, the fluid or the lubricant to be compressed by the compression unit 25 is likely to flow to the compression unit housing space 42A via the flow path 47. Therefore, compression efficiency of the compression unit 25 can be improved.

The plurality of flow paths 47 may have different circumferential widths of the annular part 44. In this way, the plurality of flow paths 47 have different widths in the circumferential direction of the annular part 44. In this manner, the plurality of flow paths 47 can be located to avoid a member located on the second surface 44*b* side of the annular part 44.

The plurality of flow paths 47 include the lower flow path 47A through which the lubricant collected in a bottom portion of the compressor casing 12 and the fluid are moved. The lower flow path 47A is formed in a lower portion of the first portion 44A.

Figure 5:
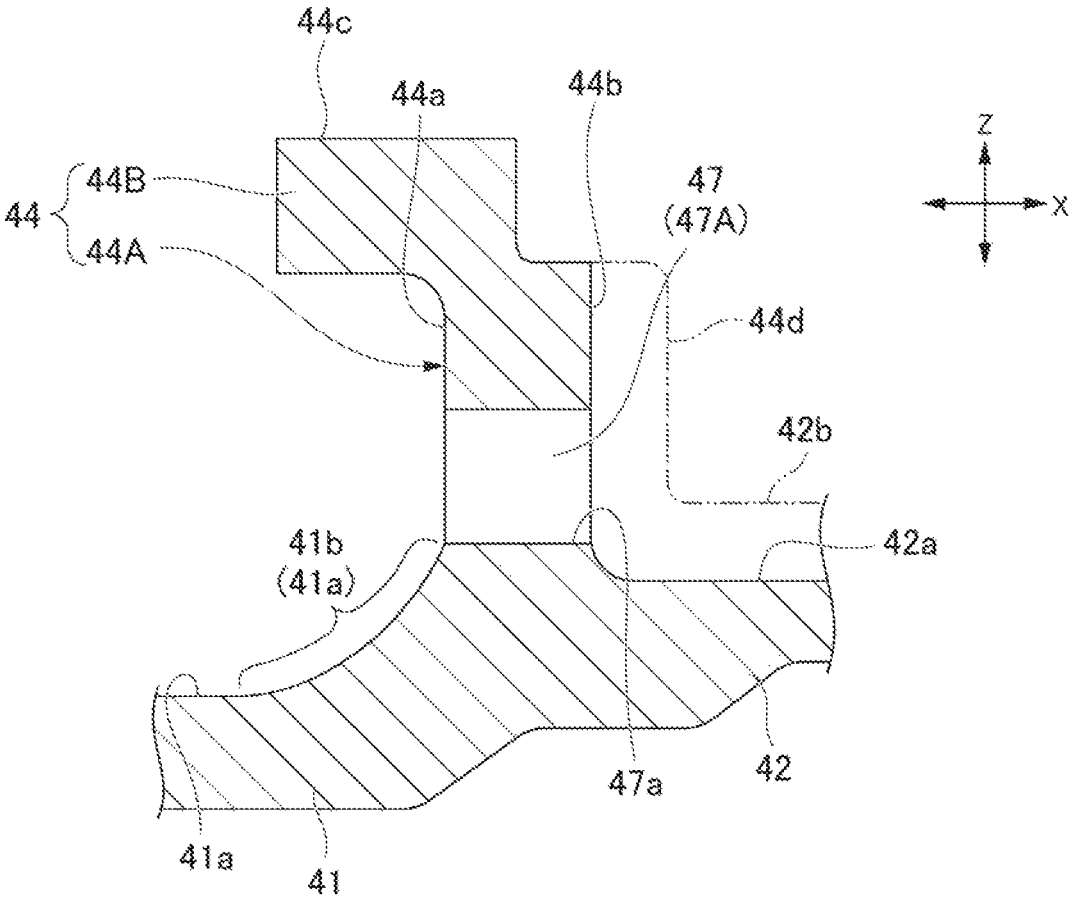
FIG. 5 is a sectional view illustrating an enlarged portion surrounded by a region C in the compressor casing illustrated in FIG. 2.

A portion adjacent to the lower flow path 47A in the first cylindrical part 41 may be reduced in diameter toward the first surface 44*a* from the other side in the direction of the axis O the first cylindrical part 41. That is, the inner peripheral surface 41*b* of the portion adjacent to the lower flow path 47A may be a curved surface as illustrated in FIG. 5.

In this way, at least a portion adjacent to the lower flow path 47A in the first cylindrical part 41 is reduced in diameter toward the first surface 44*a* from the other side of the first cylindrical part 41 in the axial direction. In this manner, a step difference formed between the first cylindrical part 41 and the lower flow path 47A can smoothed and reduced.

In this manner, the liquid lubricant collected in the lower portion of the compressor casing 12 can be easily moved to the compression unit housing space 42A side via the lower flow path 47A.

The cover 14 is a member that defines a substrate chamber, and both ends are open ends. The cover 14 is disposed in the open end of the first cylindrical part 41 on the side where the annular part 44 is not disposed.

The cover 14 has a boss portion 14A extending into the motor housing space 41A. The cover 14 is fixed to the first cylindrical part 41 by using a bolt, for example.

The first lid body 13 is disposed to close the open end of the cover 14 which is located on a side opposite to the first cylindrical part 41.

The second lid body 15 is disposed in the second cylindrical part 42 so as to close the open end of the second cylindrical part 42 on the side where the annular part 44 is not disposed. The second lid body 15 is fixed to the second cylindrical part 42 by using a bolt, for example.

The rotary shaft 17 is housed inside the compressor casing 12 in a state of extending in the X-direction.

The rotary shaft 17 has a rotary shaft main body 52 and an eccentric shaft portion 54. The rotary shaft main body 52 has one end portion 52A located on the cover 14 side and the other end portion 52B located on the second lid body 15 side.

The one end portion 52A has a columnar shape. The one end portion 52A has a smaller diameter than a portion of the rotary shaft main body 52 which excludes the one end portion 52A and the other end portion 52B. The one end portion 52A is rotatably supported by the radial bearing 19 disposed on an inner peripheral surface of the boss portion 14A.

The other end portion 52B has a columnar shape. The other end portion 52B has a larger diameter than a portion excluding the one end portion 52A and the other end portion 52B. The other end portion 52B is rotatably supported by the radial bearing 21 disposed on the inner peripheral surface 44*c* of the annular part 44.

The eccentric shaft portion 54 is disposed on a side facing the compression unit 25 in the other end portion 52B. The eccentric shaft portion 54 is disposed at a position shifted from the axis O. The eccentric shaft portion 54 extends in the X-direction. The eccentric shaft portion 54 is housed inside the drive bush 22 having a cylindrical shape.

The rotary shaft 17 configured as described above is rotated around the axis O by the motor 24.

The motor 24 has a rotor 56 and a stator 57. The rotor 56 is fixed to an outer peripheral surface of the rotary shaft main body 52 located between the one end portion 52A and the other end portion 52B. The stator 57 is fixed to the inner peripheral surface 41*a* of the first cylindrical part 41. The stator 57 is located outward in the radial direction of the rotor 56 in a state where a gap is interposed between the stator 57 and the rotor 56.

The compression unit 25 is located in the compression unit housing space 42A inside the compressor casing 12. The compression unit 25 has a movable scroll 61 and a fixed scroll 63. The movable scroll 61 and the fixed scroll 63 are located to face each other in the X-direction.

The movable scroll 61 has an end plate portion 61A, a boss portion 61B, and a scroll portion 61C. The end plate portion 61A faces the end plate portion 63A of the fixed scroll 63 in the X-direction.

The boss portion 61B is disposed on a surface facing the rotary shaft 17 in the end plate portion 61A. The boss portion 61B has a cylindrical shape.

The scroll portion 61C is disposed on a surface facing the fixed scroll 63 in the end plate portion 61A. The scroll portion 61C extends in a direction toward the fixed scroll 63.

The fixed scroll 63 is fixed to the inside (inner peripheral surface 42*a*) of the compressor casing 12. The fixed scroll 63 has an end plate portion 63A, a scroll portion 63B, and a discharge hole 63C.

The scroll portion 63B is disposed on a surface of the end plate portion 63A on a side facing the movable scroll 61. The scroll portion 63B meshes with the scroll portion 61C. A space 65 for compressing the fluid is formed between the movable scroll 61 and the fixed scroll 63.

The discharge hole 63C is formed to penetrate a central portion of the end plate portion 63A. The discharge hole 63C is a hole for discharging the completely compressed fluid.

The thrust bearing 29 is disposed on the second surface 44*b* of the annular part 44. The thrust bearing 29 faces the end plate portion 61A via the thrust plate 31 in the X-direction.

The thrust plate 31 is a ring-shaped plate. The thrust plate 31 is located between the end plate portion 61A and the thrust bearing 29.

The Oldham ring 33 is disposed inside the thrust plate 31.

According to the compressor casing 12 in the first embodiment, a portion of the inner peripheral surface 47*a* of the flow path 47 formed in the annular part 44 is located outward in the radial direction from the inner peripheral surface 42*b* of the second cylindrical part 42 before the machining is performed. In this manner, it is possible to increase the flow path cross-sectional area of the flow path 47.

In the first embodiment, the scroll compressor has been described as an example of the compression unit 25. However, the present invention is also applicable to a case where the compressor casing 12 according to the first embodiment houses the compressor other than the scroll compressor.

In addition, the shape, the arrangement, and the number of the flow paths 47 illustrated in FIGS. 2 and 3 are examples. The shape, the arrangement, and the number of the flow paths 47 can be selected as appropriate, and are not limited to the configuration illustrated in FIGS. 2 and 3.

Next, a method for manufacturing the compressor casing 12 of the first embodiment will be described with reference to FIGS. 2, 6, and 7. In describing the method for manufacturing the compressor casing 12 according to the first embodiment, the casing blank 70 according to the first embodiment will be described. In FIG. 7, surfaces (specifically, the inner peripheral surfaces 41*a* and 42*a*, and the second surface 44*b*) formed when the inside of the casing blank 70 is machined are illustrated using dotted lines. In FIG. 7, the same reference numerals are given to configuration materials which are the same as those in the structure illustrated in FIG. 2.

Figure 6:
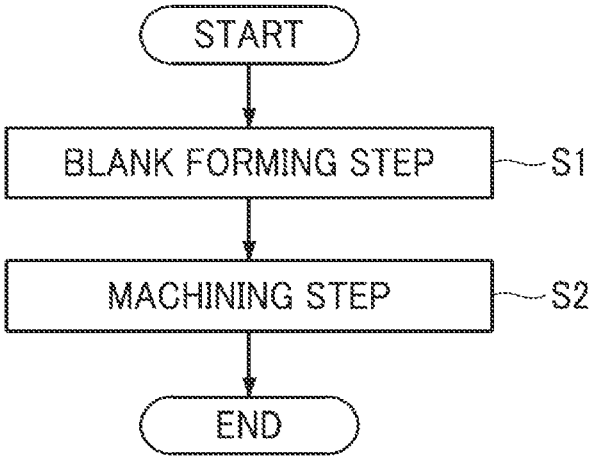
FIG. 6 is a flowchart for describing a method for manufacturing the compressor casing according to the first embodiment.

First, if a process illustrated in FIG. 6 starts, a blank forming step of forming the casing blank 70 illustrated in FIG. 7 is performed in S1.

Specifically, die cast molding is used to form the casing blank 70 having the first cylindrical part 41 which internally defines the motor housing space 41A, the second cylindrical part 42 which internally defines the compression unit housing space 42A having the smaller diameter than the motor housing space 41A, and which is connected to one side of the first cylindrical part 41 in the direction of the axis O, and the annular part 44 including the plurality of recessed portions 71 recessed from the first surface 44*a* in the direction toward the one side in the direction of the axis O. Each position for forming the plurality of recessed portions 71 corresponds to each position for forming the plurality of flow paths 47 illustrated in FIG. 3.

In the die cast molding, molten metal (for example, molten aluminum alloy) is poured into a mold (not illustrated), and the molten metal is solidified by cooling, thereby forming the casing blank 70.

The plurality of recessed portions 71 are formed by disposing a protruding portion (not illustrated) corresponding to the position and the shape of the plurality of recessed portions 71 inside a mold (not illustrated) used for the die cast molding. In this case, a bottom portion (portion formed on the second surface 44*d* side) of the plurality of recessed portions 71 is formed to reach the position of the second surface 44*b* after a machining step (to be described later) is performed.

In this way, the bottom portion of the plurality of recessed portions 71 is formed to reach the position of the second surface 44*b* after the machining step is performed. In this manner, the plurality of flow paths 47 can be formed by machining the second surface 44*d* of the annular part 44 and the inner peripheral surface 42*b* of the second cylindrical part 42.

The plurality of recessed portions 71 may be formed to have different circumferential widths of the annular part 44.

In this way, the plurality of the recessed portions 71 have different widths in the circumferential direction of the annular part 44. In this manner, the plurality of recessed portions 71 can be located to avoid a member located on the second surface 44*b* side of the annular part 44. In this manner, the plurality of flow paths 47 can be located to avoid the member located on the second surface 44*b* side of the annular part 44.

The first cylindrical part 41, the second cylindrical part 42, and the annular part 44 at this stage are thicker than the first cylindrical part 41, the second cylindrical part 42, and the annular part 44 of the compressor casing 12 illustrated in FIG. 2.

In addition, in the above-described blank forming step, the plurality of the recessed portions 71 are formed so that a portion of the side surface 71*a* of the plurality of recessed portions 71 is located outward in the radial direction from the inner peripheral surface 42*a* of the second cylindrical part 42.

In addition, the plurality of recessed portions 71 may include a lower recessed portion 71A formed in the lower portion of the annular part 44. Then, in the above-described blank forming step, the casing blank 70 may be formed so that at least a portion adjacent to the lower recessed portion 71A in the first cylindrical part 41 is reduced in diameter toward the first surface 44*a* from the other side of the first cylindrical part 41 in the direction of the axis O.

In this way, the casing blank 70 is formed so that at least the portion adjacent to the lower recessed portion 71A in the first cylindrical part 41 is reduced in diameter toward the first surface 44*a* from the other side of the first cylindrical part 41 in the direction of the axis O. In this manner, a step difference formed between the first cylindrical part 41 and the annular part 44 can be smoothed and reduced.

In this manner, the liquid lubricant collected in the lower portion of the casing blank 70 can be easily moved to the compression unit housing space 42A side.

In addition, according to the casing blank 70 in the first embodiment, the casing blank 70 has the annular part including the plurality of recessed portions 71 in which the side surface 71*a* is located outward in the radial direction from the inner peripheral surface 42*b* of the second cylindrical part 42. Accordingly, it is possible to increase the diameter of the plurality of recessed portions 71.

In this manner, it is possible to obtain the flow path 47 (for example, the flow path of the fluid or the lubricant) having a larger flow path cross-sectional area than the flow path in the related art.

Next, in S2, the inside of the casing blank 70 illustrated in FIG. 7 is machined. In this manner, each diameter of the motor housing space 41A and the compression unit housing space 42A is adjusted to have a desired size, and the plurality of flow paths 47 are formed (machining step).

In the above-described machining step, the machining is performed on the inner peripheral surface 41*b* of the first cylindrical part 41, the inner peripheral surface 42*b* of the second cylindrical part 42, and the second surface 44*d* of the annular part 44 (in other words, the first cylindrical part 41, the second cylindrical part 42, and the annular part 44 are thinned).

In this manner, the inner peripheral surfaces 41*a* and 42*a* and the second surface 44*b* are formed. In this manner, the compressor casing 12 illustrated in FIG. 2 is manufactured. In the above-described machining step, for example, it is possible to adopt machining using a milling cutter, inner diameter machining, or machining using an end mill.

According to the method for manufacturing the compressor casing 12 in the first embodiment, the die cast molding is used. In this manner, it is possible to form the plurality of recessed portions 71 in the die casting step of forming the casing blank 70 without separately providing a step of forming the plurality of recessed portions 71 in which the side surface 71*a* is located outward in the radial direction from the inner peripheral surface 42*a* of the second cylindrical part 42. Therefore, it is possible to simplify the manufacturing steps.

In addition, the inner peripheral surface 42*b* of the second cylindrical part 42 and the second surface 44*d* of the annular part 44 are machined, thereby causing the plurality of recessed portions 71 to communicate with the compression unit housing space 42A. In this manner, it is possible to form the plurality of flow paths 47 having the larger flow path cross-sectional area than the flow path in the related art.

In addition, the plurality of recessed portions 71 is caused to communicate with the compression unit housing space 42A during the machining performed as finishing work for the compression unit housing space 42A. In this manner, it is possible to prevent an increase in the steps for forming the plurality of flow paths 47.

Second Embodiment

Figure 8:
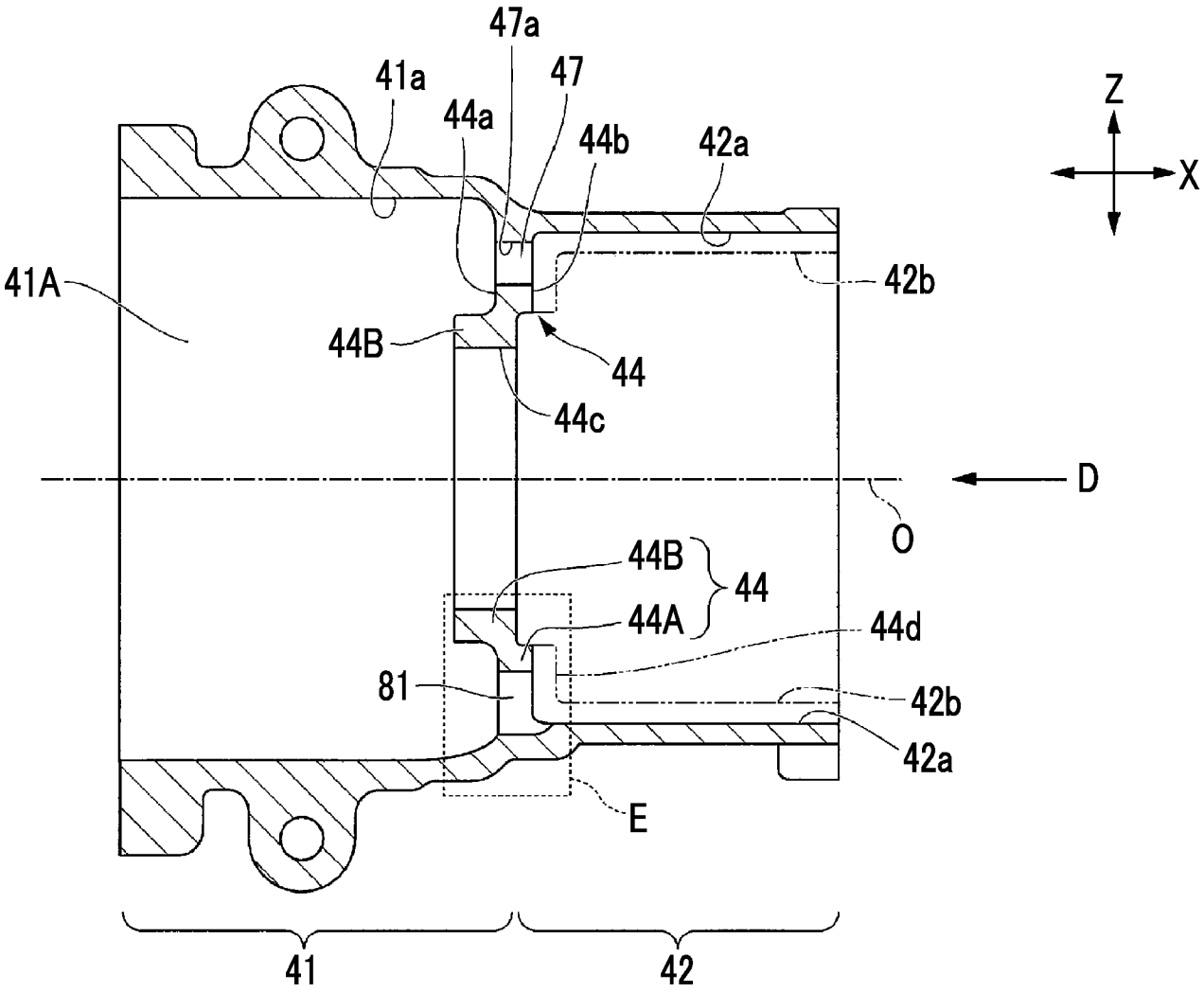
FIG. 8 is a sectional view of a compressor casing according to a second embodiment of the present invention.
Figure 9:
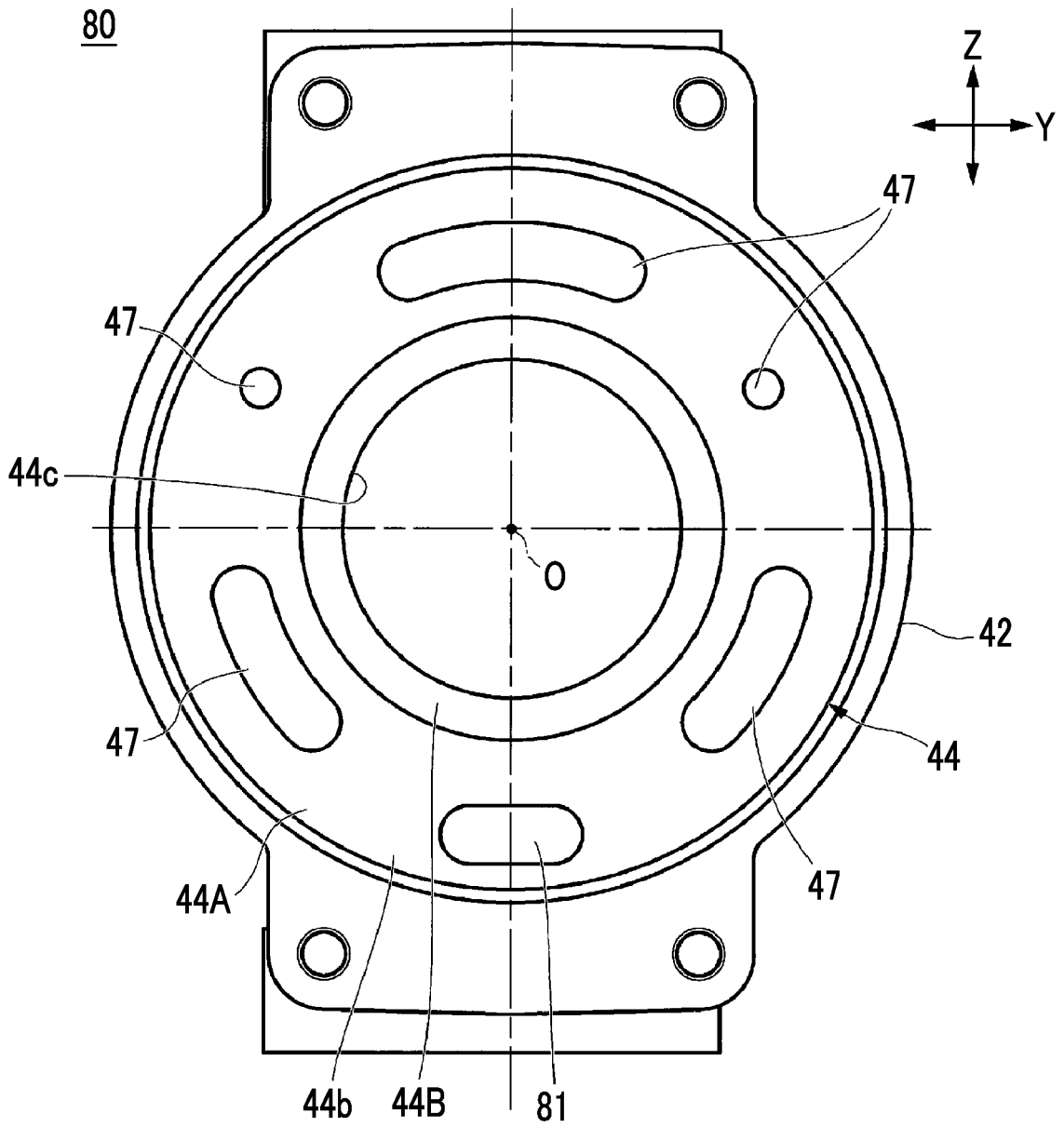
FIG. 9 is a view when the compressor casing illustrated in FIG. 8 is viewed from an arrow D.
Figure 10:
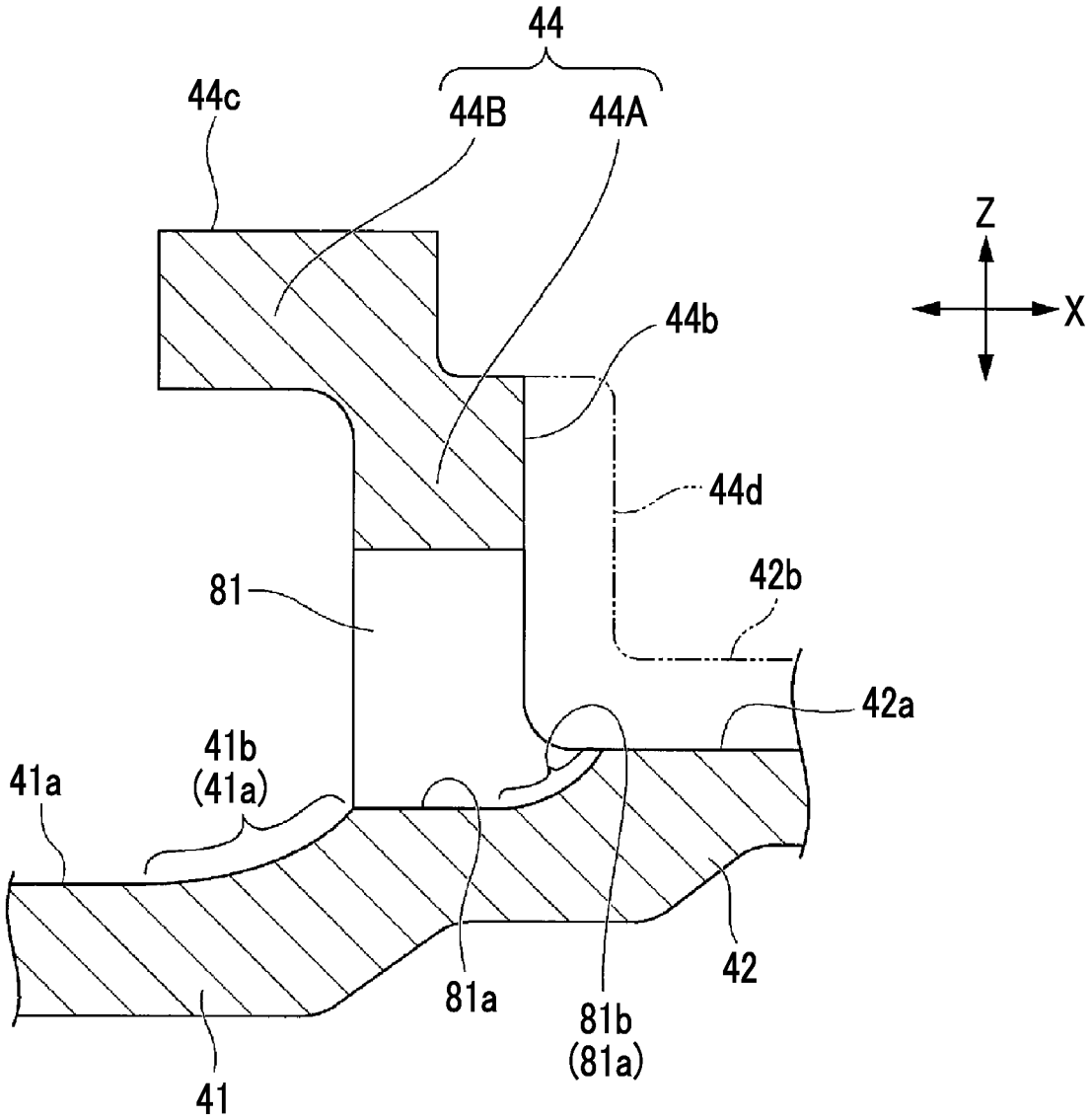
FIG. 10 is a sectional view illustrating an enlarged portion surrounded by a region E in the compressor casing illustrated in FIG. 8.

A compressor casing 80 according to a second embodiment will be described with reference to FIGS. 8 to 10. In FIGS. 8 to 10, the same reference numerals will be given to configuration materials which are the same as those in the structure illustrated in FIGS. 1 to 5 and 7. In addition, in FIGS. 8 to 10, the same reference numerals will be given to the same configuration materials.

The compressor casing 80 according to the second embodiment has the same configuration as the compressor casing 12 except that the compressor casing 80 has a lower flow path 81 instead of the lower flow path 47A configuring the compressor casing 12 according to the first embodiment.

A portion of the lower flow path 81 is formed in the second cylindrical part 42. In this manner, the lower flow path 81 extends to the compression unit housing space 42A.

According to this configuration, it is possible to increase the flow path cross-sectional area of the lower flow path 81 on the second surface 44*b* side of the annular part 44.

At least a surface 81*b* located on the inner peripheral surface 42*a* side of the second cylindrical part 42 on a partial surface 81*a* of the lower flow path 81 is a curved surface.

At least the surface 81*b* located on the inner peripheral surface 42*a* side of the second cylindrical part 42 on the partial surface 81*a* of the lower flow path 81 formed in the second cylindrical part 42 is the curved surface. In this manner, the liquid lubricant can easily flow to the inner peripheral surface 42*a* side of the second cylindrical part 42 via the lower flow path 81.

In addition, in a state where the annular part 44 is viewed from the motor housing space 41A side in the direction of the axis O, the lower flow path 81 is located to further extend to the outer peripheral side of the annular part 44 from the other flow path 47.

In this way, in the state where the annular part 44 is viewed from the motor housing space 41A side in the direction of the axis O, the lower flow path 81 is located to further extend to the outer peripheral side of the annular part 44 from the other flow path 47. Accordingly, it is possible to decrease the step difference formed between the first cylindrical part 41 and the lower flow path 81.

In this manner, the lubricant collected in the lower portion of the motor housing space 41A can be easily moved to the compression unit housing space 42A side.

According to the compressor casing 80 in the second embodiment, the compressor casing 80 has the lower flow path 81 which is partially formed in the second cylindrical part 42 and which extends to the compression unit housing space 42A. In this manner, it is possible to increase the flow path cross-sectional area of the lower flow path 81 on the second surface 44*b* side of the annular part 44.

In this manner, the lubricant in a liquid state and the fluid can easily move to the compression unit housing space 42A via the lower flow path 81. Accordingly, it is possible to improve compression efficiency of the compression unit 25.

In the second embodiment, the following case has been described as an example. As illustrated in FIG. 8, only a portion of the lower flow path 81 is formed in the second cylindrical part 42 so as to extend to the compression unit housing space 42A. However, the flow path 47 other than the lower flow path 81 may have the same configuration as the lower flow path 81.

The above-described compressor casing 80 can be manufactured using a method the same as the method for manufacturing the compressor casing 12 according to the previously described first embodiment, except that the recessed portion serving as the lower flow path 81 is formed outside the recessed portion serving as the flow path 47. Accordingly, the same advantageous effect can be achieved.

Hitherto, the preferred embodiments according to the present invention have been described in detail. However, the present invention is not limited to the specific embodiments, and various modifications and variations can be made within the scope of the gist of the appended claims.

INDUSTRIAL APPLICABILITY

The present invention is applicable to a method for manufacturing a compressor casing, a casing blank, and a compressor casing.

REFERENCE SIGNS LIST

10: compressor
12, 80: compressor casing
13: first lid body
14: cover
14A, 61B: boss portion
15: second lid body
17: rotary shaft
19, 21, 27: radial bearing
22: drive bush
24: motor
25: compression unit
29: thrust bearing
31: thrust plate
33: Oldham ring
41: first cylindrical part
41*a*, 41*b*, 42*a*, 42*b*: inner peripheral surface
41A: motor housing space
42: second cylindrical part
42A: compression unit housing space
44: annular part
44*a*: first surface
44*b*, 44*d*: second surface
44*c*: inner peripheral surface
44A: first portion
44B: second portion
47: flow path
47A, 81: lower flow path
52: rotary shaft main body
52A: one end portion
52B: other end portion
54: eccentric shaft portion
56: rotor
57: stator
61: movable scroll
61A, 63A: end plate portion
61C, 63B: scroll portion
63: fixed scroll
63C: discharge hole
65: space
70: casing blank
71: recessed portion
71*a*: side surface
81*a*, 81*b*: surface
O: axis

The invention claimed is:

1. A method for manufacturing a compressor casing, comprising:

a blank forming step of using die cast molding to form a casing blank having a first cylindrical part which has a cylindrical shape around an axis, and which internally defines a motor housing space, a second cylindrical part which has a cylindrical shape around the axis, which internally defines a compression unit housing space having a smaller diameter than the motor housing space, and which is connected to the first cylindrical part and positioned on one side in an axial direction along the axis than the first cylindrical part, and an annular part which protrudes inward in a radial direction from an inner peripheral surface of a boundary portion between the first cylindrical part and the second cylindrical part, and which includes a recessed portion recessed toward the one side in the axial direction from a first surface facing the other side in the axial direction, wherein an end of the recessed portion on the one side in the axial direction is closed by a second surface of the annular part facing the one side and the compression unit housing space in the axial direction, and the recessed portion does not communicate with the compression unit housing space; and a machining step of forming a flow path in such a way that the recessed portion is caused to communicate with the compression unit housing space by machining an inner peripheral surface of the second cylindrical part that extends toward the one side in the axial direction from an outer end in the radial direction of the second surface of the annular part and the second surface of the annular part facing the one side in the axial direction, wherein in the blank forming step, the casing blank is formed so that a portion of a side surface of the recessed portion is located outward in the radial direction from the inner peripheral surface of the second cylindrical part and the recessed portion and the annular part are integrally formed.

2. The method for manufacturing a compressor casing according to claim 1, wherein in the machining step, the annular part is thinned so that a portion of the flow path is located in the second cylindrical part.

3. The method for manufacturing a compressor casing according to claim 1, wherein in the blank forming step, a plurality of the recessed portions are formed in a circumferential direction of the annular part.

4. The method for manufacturing a compressor casing according to claim 3, wherein the plurality of recessed portions include a lower recessed portion formed in a lower portion of the annular part, and wherein in the blank forming step, the casing blank is formed so that at least a portion adjacent to the lower recessed portion in the first cylindrical part is reduced in diameter toward the first surface from an end portion on the other side in the axial direction of the portion adjacent to the lower recessed portion in the first cylindrical part.

5. The method for manufacturing a compressor casing according to claim 4, wherein in the blank forming step, in a state where the annular part is viewed in the axial direction from the motor housing space of the first cylindrical part, the lower recessed portion is formed to further extend to an outer peripheral side of the annular part from the other recessed portion.

6. The method for manufacturing a compressor casing according to claim 3, wherein in the blank forming step, the plurality of recessed portions are formed to have different circumferential widths of the annular part.

7. A casing blank comprising:

a first cylindrical part which has a cylindrical shape around an axis, and which internally defines a motor housing space;

a second cylindrical part which has a cylindrical shape around the axis, which internally defines a compression unit housing space having a smaller diameter than the motor housing space, and which is connected to one side of the first cylindrical part and positioned on one side in an axial direction along the axis than the cylindrical part; and an annular part which protrudes inward in a radial direction from an inner peripheral surface of a boundary portion between the first cylindrical part and the second cylindrical part, and which includes a recessed portion recessed toward the one side in the axial direction from a first surface facing the other side in the axial direction, wherein an end of the recessed portion on the one side in the axial direction is closed by a second surface of the annular part facing the one side and the compression unit housing space in the axial direction, and the recessed portion does not communicate with the compression unit housing space, wherein a portion of a side surface of the recessed portion is located outward in the radial direction from an inner peripheral surface of the second cylindrical part, and wherein the recessed portion and the annular part are integrally formed, and the recessed portion serves as a flow path which causes the motor housing space and the compression unit housing space to communicate with each other by machining an inner peripheral surface of the second cylindrical part that extends toward the one side in the axial direction from an outer end in the radial direction of the second surface of the annular part and the second surface of the annular part facing the one side in the axial direction.

8. The casing blank according to claim 7, wherein a plurality of the recessed portions are formed in a circumferential direction of the annular part.

9. The casing blank according to claim 8, wherein the plurality of recessed portions have a lower recessed portion formed in a lower portion of the annular part, and wherein at least a portion adjacent to the lower recessed portion in the first cylindrical part is reduced in diameter toward the first surface from the other side of the first cylindrical part in the axial direction.

10. The casing blank according to claim 9, wherein in a state where the annular part is viewed in the axial direction from the motor housing space of the first cylindrical part, the lower recessed portion is located to further extend to an outer peripheral side of the annular part from the other recessed portion.

11. The casing blank according to claim 8, wherein the plurality of recessed portions have different circumferential widths of the annular part.

12. A compressor casing comprising:

a first cylindrical part which has a cylindrical shape around an axis, and which internally defines a motor housing space;

a second cylindrical part which has a cylindrical shape around the axis, which internally defines a compression unit housing space having a smaller diameter than the motor housing space, and which is connected to the first cylindrical part and positioned on one side in an axial direction along the axis than the first cylindrical part; and an annular part which protrudes inward in a radial direction from an inner side of a boundary portion between the first cylindrical part and the second cylindrical part, and which includes a flow path that causes the motor housing space and the compression unit housing space to communicate with each other, wherein the flow path is formed in such a way that a recessed portion integrally formed in the annular part is caused to communicate with the compression unit housing space by machining a surface of the annular part facing the one side and the compression unit housing space in the axial direction and an inner peripheral surface of the second cylindrical part before the machining that extends toward the one side in the axial direction from an outer end in the radial direction of the surface of the annular part, wherein an end of the recessed portion on the one side in the axial direction is closed by, the surface of the annular part, and the recessed portion does not communicate with the compression unit housing space, and wherein a portion of an inner peripheral surface of the flow path is located outward in the radial direction from the inner peripheral surface of the second cylindrical part before the machining is performed.

13. The compressor casing according to claim 12, wherein a portion of the flow path is formed in the second cylindrical part, and the flow path extends to the compression unit housing space.

14. The compressor casing according to claim 12, wherein a plurality of the flow paths are formed in a circumferential direction of the annular part.

15. The compressor casing according to claim 14, wherein the plurality of flow paths have a lower flow path formed in a lower portion of the annular part, and wherein a portion adjacent to the lower flow path in the first cylindrical part is reduced in diameter toward the first surface of the annular part facing the other side in the axial direction from a part of the first cylindrical part which is positioned on the other side in the axial direction than the first surface.

16. The compressor casing according to claim 15, wherein a portion of the lower flow path is formed in the second cylindrical part, and wherein at least a surface located on the inner peripheral surface side of the second cylindrical part on the partial surface of the lower flow path is a curved surface.

17. The compressor casing according to claim 15, wherein in a state where the annular part is viewed in the axial direction from the motor housing space side of the first cylindrical part, the lower flow path is located to further extend to an outer peripheral side of the annular part from the other flow path.

18. The compressor casing according to claim 14, wherein the plurality of flow paths have different circumferential widths of the annular part.

19. The compressor casing according to claim 12, wherein the first cylindrical part, the second cylindrical part and an annular part are integrally formed.

* * * * *